United States Patent [19]

Skelley et al.

[11] Patent Number: 4,928,975

[45] Date of Patent: May 29, 1990

[54] GOLF PUTTING PRACTICE APPARATUS

[76] Inventors: Keith Skelley; William G. Skelley, both of 115 Broadmeadow Cove, Roswell, Ga. 30075

[21] Appl. No.: 364,175

[22] Filed: Jun. 12, 1989

[51] Int. Cl.[5] ..... A63B 69/36

[52] U.S. Cl. ..... 273/192; 273/186 C

[58] Field of Search ..... 273/191 R, 191 A, 191 B, 273/192, 186 R, 186 C, 183 E, 187 R, 183 R, 186 B, 186 D

[56] References Cited

U.S. PATENT DOCUMENTS

| | | | |
|---|---|---|---|
| 1,944,942 | 1/1934 | MacDonald | 273/191 A |
| 3,339,927 | 9/1967 | Nunn | 273/191 A |
| 3,482,838 | 12/1969 | Gibson et al. | 273/186 R |
| 3,806,133 | 4/1974 | Cork | 273/192 |
| 3,857,570 | 12/1974 | Gutierrez et al. | 273/186 C |
| 3,953,035 | 4/1976 | Beckisk | 273/192 |
| 4,230,319 | 10/1980 | Lindner | 273/192 |
| 4,423,875 | 1/1984 | Miller | 273/186 C |
| 4,437,669 | 3/1984 | Pelz | 273/186 C |
| 4,563,010 | 1/1986 | McDorman et al. | 273/187 R |
| 4,736,952 | 4/1988 | Taft et al. | 273/183 E |

*Primary Examiner*—George J. Marlo

*Attorney, Agent, or Firm*—Thomas & Kennedy

[57] ABSTRACT

Apparatus for practicing golf putting has a pair of slide rails 12,13 supported along a common plane against which a putter shaft may be slid. The apparatus also has a support by which the rails are positioned above a playing surface at a height to contact the putter shaft at various angles of incline. The support may comprise a pair of front legs 14 to which a pair of rear legs 18 are pivoted. The rear legs may themselves be slotted or adjustably secured to slotted ground rails.

5 Claims, 2 Drawing Sheets

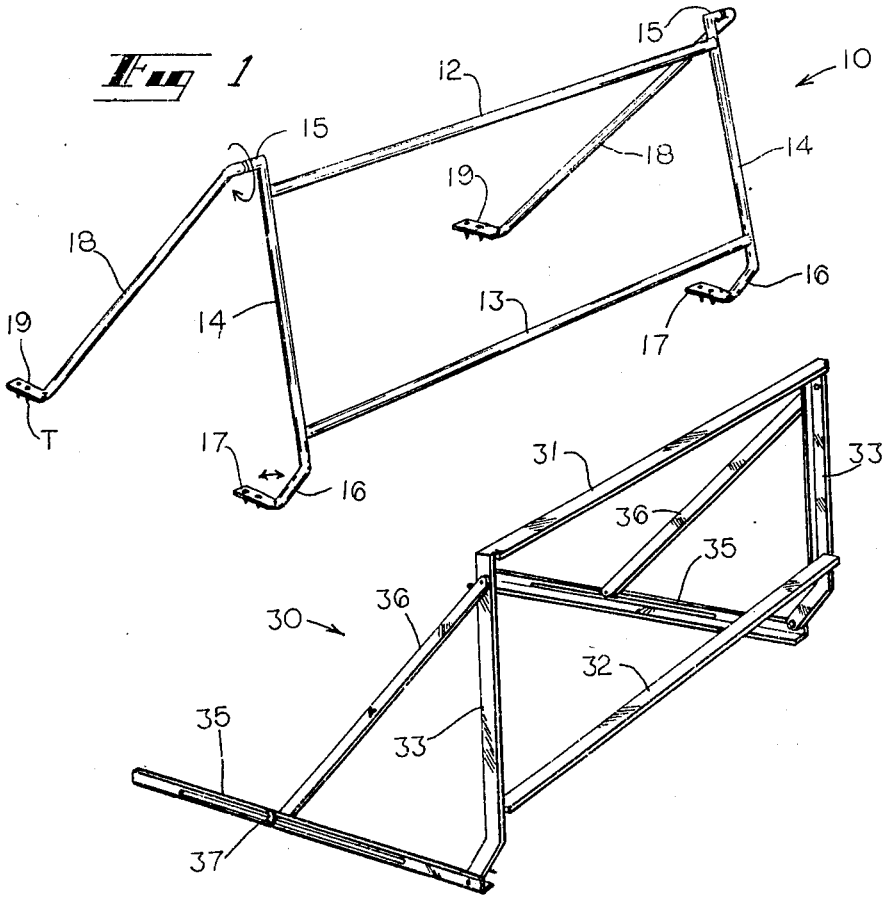
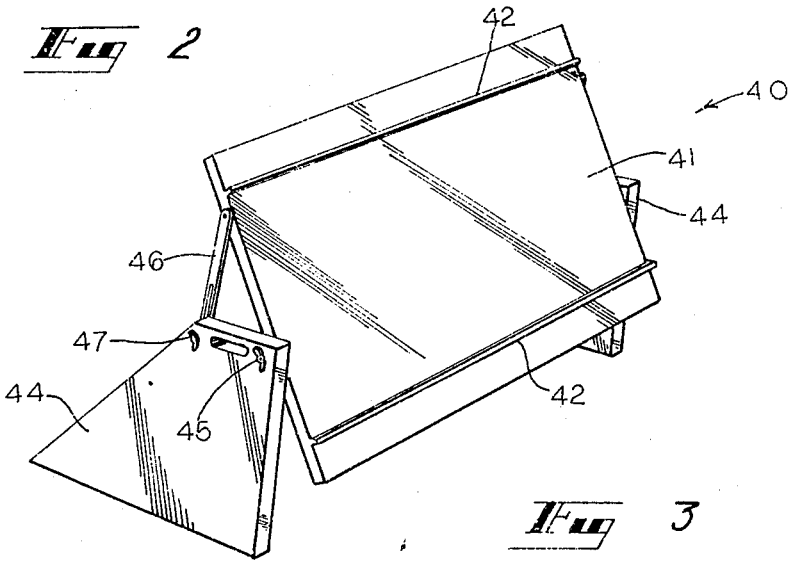
Fig 3

GOLF PUTTING PRACTICE APPARATUS

TECHNICAL FIELD

This invention relates generally to apparatuses for practicing golf and particularly to apparatuses for practicing putting.

BACKGROUND OF THE INVENTION

One, if not the most difficult aspects of golf, is that of putting. Its importance cannot be minimized since about half of the strokes taken in a round of golf are putts. Seemingly, the golf stroke should be relatively easy to execute since it is relatively short and requires no movement of the torso or body weight shift. Unfortunately, most golfers find such simplicity to be an illusion.

Preparatory to executing a putt a golfer must survey that portion of the green located between his or her ball and the cup to determine which way the ball will curve or "break", whether the course of travel is uphill or downhill, and the magnitude of such terrain deviations from a level surface. Once this is done the golfer merely has to stroke the ball in a predetermined direction with sufficient force for the ball to roll to the cup. However, this is far easier to say than to do well.

Heretofore physical aids have been devised for use in training golfers to putt. To Applicant's knowledge none have been devised as an aid in training golfers to stroke with proper force; nor is the present invention directed to such. Instead, the aids proposed or actually developed for use in enhancing a golfer's ability to putt have comprised a track having a pair of spaced, parallel guides between which one swings the putter head. Deviations in movement of the head between the two guides are sensed visually or by contact of the putter head with one of the guides. Exemplary of such putting aids are those shown in U.S. Pat. Nos. 4,230,319, 4,423,875 and 4,437,669.

The limited success achievable by devices of the type just described is believed to be attributable to the absence of physical sensory inputs. A golfer will mentally know when he or she has executed a putt well with such a device by visual observation and the absence of external force or shock. However, repetition without reliance on the aid is dependant on memory of the body movement that produces good putts. In other words, one must somehow recall and repeat a movement that was correct as measured by the absence of a physical input, i.e. feeling the putter head not contact a guide.

Heretofore, such a positive sensory input has been provided by the golf club swing training device disclosed in U.S. Pat. No. 3,953,035, which, surprisingly, actually preceded the just described aids. This device provides means for slidably securing the shaft of a golf club to a rail supported above a playing surface, which rail extends along an ideal club swing path for short golf shots such as pitches and putts. By swinging the club slidably attached to the rail the trainee may feel the club as it transits an ideal path of travel while being moved by the trainee. In this manner a positive sensory input is made.

Unfortunately, there are two serious problems associated with positive feedback training aids of the just described type. A rather obvious one is the lack of sufficient accommodation for individuals of differing stature. In other words, only very limited adjustment is provided by the device to personalize it. A more subtle limitation is the rigidity provided in actually coupling the club to the device. This makes for difficulty in making the transition from use of the aid to actual play without the aid.

Accordingly, it is seen that were apparatus to be devised that could be used in a manner to provide some degree of positive input feel while retaining a balanced degree of swing freedom, a distinct advance in the art could be achieved. This would facilitate transition from aided practice to actual play. It is to the provision of such therefore that the present invention is primarily directed.

SUMMARY OF THE INVENTION

In a preferred form of the invention apparatus is provided for use in practicing golf strokes with a golf club of the type having a shaft that extends between a handle and a head. The apparatus comprises guide means having guide surfaces for guiding a portion of the club shaft located adjacent the club handle and a portion of the club shaft located adjacent the club head along a common plane. It also has means for supporting the guide means guide surfaces above a golf ball playing surface with the common plane positionable at selected angles of incline with respect to the golf ball playing surface.

In another preferred form of the invention apparatus is provided for use in practicing short golf strokes with a golf club of the type that has a shaft that extends between a handle and a club head. The apparatus comprises a pair of rails rigidly mounted together in substantially parallel relation to form a club shaft guide assembly. The apparatus also has means for supporting the guide assembly pair of rails one over the other above a golf playing surface along a variety of angles of incline with respect to the golf playing surface.

BRIEF DESCRIPTION OF THE DRAWING

FIG. 1 is a perspective view of golf putting practice apparatus that embodies principles of the invention in a preferred form.

FIG. 2 is a perspective view of golf putting practice apparatus that embodies principles of the invention in another preferred form.

FIG. 3 is a perspective view of golf putting practice apparatus that embodies principles of the invention in yet another preferred form.

DETAILED DESCRIPTION

Figure 4:
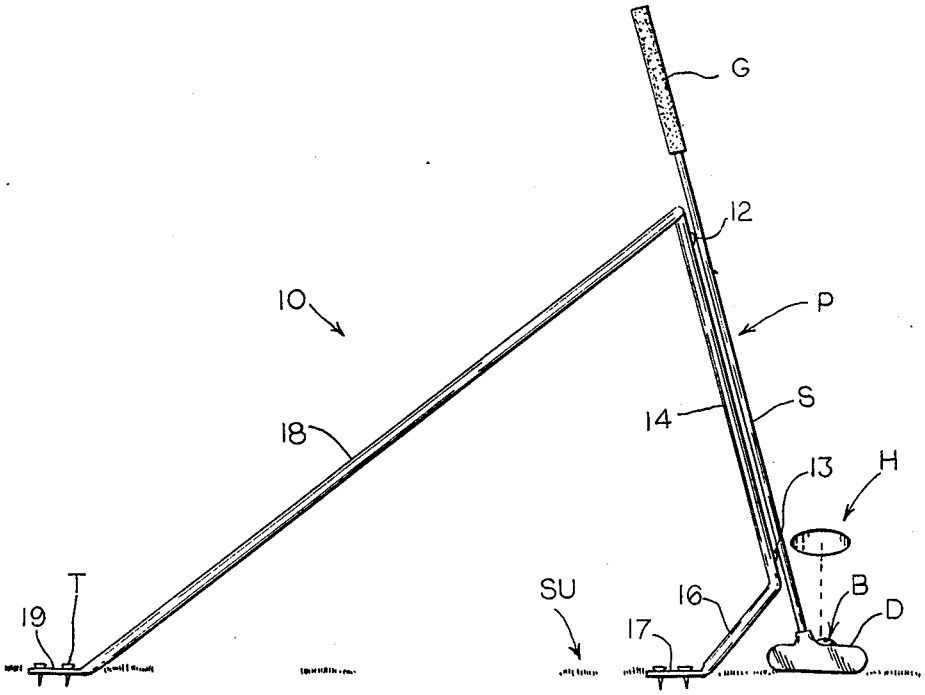
FIG. 4 is a side elevational view of the apparatus illustrated in FIG. 1 shown in use with a putter.
Figure 5:
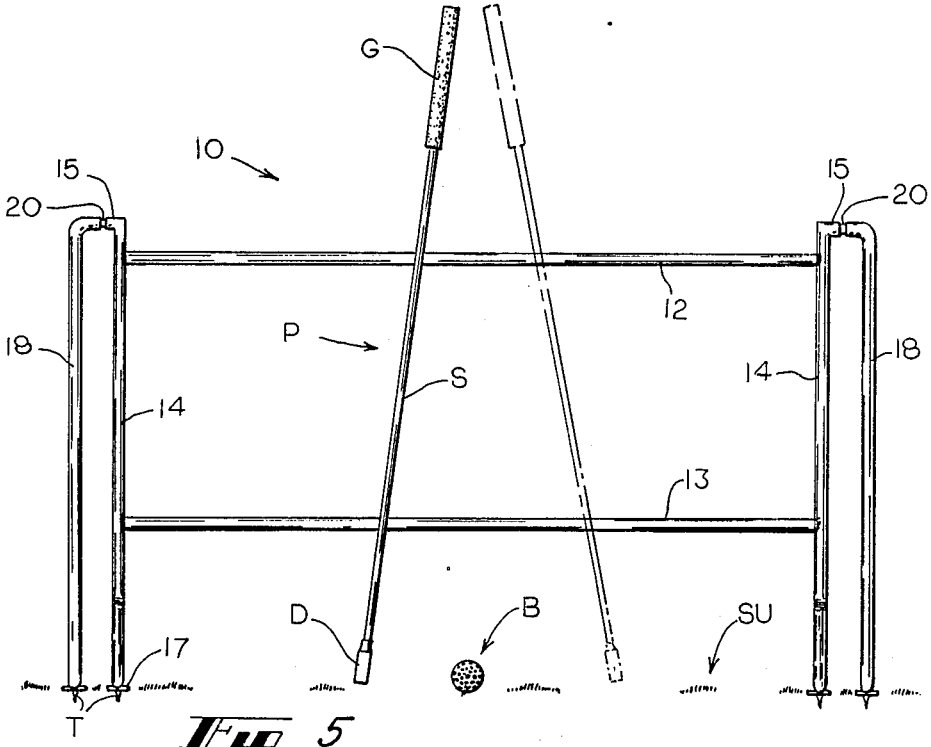
FIG. 5 is a front elevational view of the apparatus illustrated in FIG. 1 shown in use with a putter.

Referring now in more detail to the drawing, there is shown in FIGS. 1, 4 and 5 apparatus 10 for use in practicing golf strokes with a putter P in putting a ball B towards a hole H over a playing surface Su. The putter P conventionally has a shaft S that extends between a grip G and club head D. The apparatus 10 has an upper slide rail 12 and a lower slide rail 13 that are rigidly mounted in mutually parallel relation to a pair of front legs 14. These slide rails are preferably quiet smooth and slick as by being made of plastic or metal. The front legs extend linearly between and slightly beyond the upper and lower rails in mutually parallel relation. Above the upper rail the upper ends of legs 14 have outwardly extending open ends that provide sockets 15. The lower ends of the legs 14 are inturned at ankles 16 which unitarily merge with feet 17. These feet have holes through which golf tees T may be inserted in anchoring the feet to a sodded putting surface, i.e. a green. The feet are vertically located 6 to 10 inches vertically below the lower rail and 12 to 21 inches below the upper rail 12. This is done so that the rails contact the club shaft S, rather than the head, hosel or grip, at a rail spacing to provide stable coplanar sliding movement of the shaft over the rails.

The apparatus 10 also has a pair of rear legs 18. These legs are linear except for their upper and lower extremities. Their bottoms merge with feet 19 that also have holes to accept anchoring tees. Their top ends flare laterally and have pivot pins that are rotatably inserted in the sockets 15 of the front legs. With this construction it is seen that the rails 12 and 13 may jointly assume different angles of incline with respect to the playing surface Su by merely pivoting the rear legs slightly. This is done to establish a plane tangential to the front surfaces of the rails that is appropriate for the individual trainee in which to move the putter in practicing his putting strokes.

For use a trainee sets the apparatus as shown upon the putting surface Su. Where that surface is grass he may anchor the feet of the legs with standard golf tees with the slide rails oriented towards the left edge of the hole H. The slide rails 12 and 13 are set to match the natural angle that the club shaft S makes with respect to the playing surface Su for that individual. The trainee then stands centrally between the rear legs 18 and rests the shaft S of the putter P on the front surfaces of the rails 12 and 13 with the putter head D resting on the playing surface Su. With the rails elevated above the feet 17 within the range of elevations previously mentioned, neither the club head D and its hosel, nor the club grip G, contact the slide rails. Since golf putter shafts are typically made of a smooth, low resistance metal, the shaft may slide easily along the rails. The trainee does just this in practicing his putting stroke as shown in FIGS. 4 and 5.

By maintaining the shaft in free sliding contact with both of the slide rails !2 and 13 during a stroke, the putter moves along a plane so that the putter head D moves directly towards the hole H which, in FIG. 4, is on a flat, level, putting surface. So long as the trainee keeps the putter head square and in sliding contact with both rails, the putter head will travel along a proper line directly towards the hole, and drive the ball directly towards the hole H. In this manner the trainee well may feel the proper stroke motion as a positive sensor input and yet without such a degree of constraint as to render transition difficult to strokes without aid of the apparatus. The putting results achievable with the device has been found to be outstanding. More importantly, the proficiency gained is easily transferrable to actual play.

FIGS. 2 and 3 show alternative forms of the invention. In FIG. 2 the apparatus 30 similarly has a pair of parallel slide rails 31 and 32 rigidly mounted to a pair of front legs 33. The bottoms of the legs are pivoted to the ends of a pair of slotted ground rail members 35 of a ground track. A pair of rear legs 36 are pivoted to upper ends of the front legs 33. Their bottom ends have threaded pins that project through the slots of the ground track members and are secured thereto by wing nuts 37. By adjusting the secured position of the bottom of the rear legs 36 to the ground track, the angle of incline of the slide rails 31,32 may be changed to accommodate the individual user. Alternatively, the rear legs could be of two-piece, telescopic construction and their bottoms permanently secured to the ground rail member. In such case the angle of incline of the slide rails could be changed by adjusting and releasibly fixing the relative telescopic position of their pieces.

The apparatus 40 of FIG. 3 has a backboard 41 with parallel ribs 42 that provide the slide rails and sliding surfaces upon which the putter shaft may slide. The backboard is pivoted to a pair of stanchions 44 by lateral pivot pins that extend through pivot holes in the stanchions and are lightly secured thereto by wing nuts 45. A pair of slotted legs 46 are pivoted to the backboard and adjustably fastened to the stanchions by bolts that extend through the legs slots and stanchion holes and which are secured by wing nuts 47. By tilting the backboard the angle of incline of the ribs 42 may be set.

It thus is seen that apparatus is now provided that may be easily and very effectively used in practicing short golf strokes, such as chipping and putting strokes. It should be understood however that modifications, additions and deletions may be made thereto without departure from the spirit and scope of the invention as set forth in the following claims.

We claim:

1. Apparatus for use in practicing golf strokes with a golf club of the type having a shaft extending between a handle and a head, and with the apparatus comprising guide means having a pair of parallel slide rails that provide guide surfaces for guiding a portion of the club shaft located adjacent to the club handle and a portion of the club shaft located adjacent to the club head along a common plane, and means for supporting said guide means guide surfaces above a golf ball playing surface with said common plane positionable at selected angles of incline with respect to the ball playing surface, said support means comprising a first pair of legs coplanar with said rails and to which said pair of slide rails are rigidly mounted and a second pair of legs pivotably mounted to said first pair of legs.

2. The apparatus of claim 1 wherein said support means further comprises a ground track and means for reliably fastening said second pair of legs to said ground track at a plurality of locations.

3. Apparatus for use in practicing golf strokes with a golf club of the type having a shaft extending between a handle and a head, and with the apparatus comprising guide means having spaced apart linear guide surfaces for guiding a portion of the club shaft located adjacent to the club handle and a portion of the club shaft located adjacent to the club head along a common plane, and means for supporting said guide means guide surfaces above a golf ball playing surface so that said common plane is positionable at selected angles of incline with respect to the ball playing surface, said support means comprising a pair of stanchions to the front of which said guide means is pivotably mounted along a first axis in said common plane and a pair of slotted legs pivotably mounted to said guide means for supporting said guide means along a second axis in said common plane.

4. Apparatus for use in practicing golf strokes with a golf club of the type having a shaft extending between a handle and a head, and with the apparatus comprising a pair of generally parallel slide rails having guide surfaces for guiding a portion of the club shaft located adjacent to the club handle and a portion of the club shaft located adjacent to the club head along a common plane; and means for supporting said pair of slide rails above a golf ball playing surface with said common plane positionable at selected angles of incline with respect to the ball playing surface, said support means comprising a pair of ground rail members, a pair of front leg members coplanar with said rails and pivotably mounted adjacent a front end portion of said ground rail members, and a pair of rear leg members pivotably mounted to said pair of front leg members and pivotably mounted adjacent a rear end portion of said ground rail member, and wherein said pair of slide rails are rigidly mounted to said pair of front rail members.

5. The apparatus of claim 4 wherein one of said pairs of support means members is slotted and another pair of said pairs of support means members is adjustably secured thereto by a pair of wing nuts.

* * * * *